United States Patent [19]

Givan

[11] Patent Number: 4,573,364

[45] Date of Patent: Mar. 4, 1986

[54] GEAR REDUCTION STARTER DRIVE

[75] Inventor: David E. Givan, Anderson, Ind.

[73] Assignee: General Motors Corporation, Detroit, Mich.

[21] Appl. No.: 640,939

[22] Filed: Aug. 15, 1984

[51] Int. Cl.[4] ..... F02N 15/06

[52] U.S. Cl. ..... 74/7 E; 74/7 C; 74/421 A; 74/801; 310/83

[58] Field of Search ..... 74/7 R, 7 A, 7 C, 7 E, 74/801, 421 A; 290/38 R, 38 C, DIG. 1; 310/83

[56] References Cited

U.S. PATENT DOCUMENTS

| | | | |
|---|---|---|---|
| 1,287,305 | 12/1918 | Heinze . | |
| 2,354,844 | 8/1944 | Thornburg | 74/6 |
| 2,400,789 | 5/1946 | Thornburg . | |
| 3,209,603 | 10/1965 | Rodriguez | 74/7 |
| 4,325,265 | 4/1982 | Wakatsuki et al. | 74/7 R |
| 4,412,457 | 11/1983 | Colvin et al. | 74/7 E X |
| 4,510,406 | 4/1985 | Morishita | 74/7 E X |
| 4,519,261 | 5/1985 | Hamano | 74/7 E |
| 4,528,470 | 7/1985 | Young et al. | 74/7 E |
| 4,528,870 | 7/1985 | Van Deursen et al. | 74/701 |

FOREIGN PATENT DOCUMENTS

| | | | |
|---|---|---|---|
| 590324 | 6/1925 | France | 74/7 E |

*Primary Examiner*—Allan D. Herrmann
*Attorney, Agent, or Firm*—C. R. Meland

[57] ABSTRACT

An in-line gear reduction starter drive for driving a pinion from the armature of an electric cranking motor. The drive utilizes a single central shaft that is directly connected to the armature core of the cranking motor armature and the pinion is supported by the shaft. The shaft has an integral gear which forms the sun gear of a planetary gear set. The sun gear drives planet gears which in turn drive a driven member that is rotatably supported by the shaft and which drives the pinion.

5 Claims, 4 Drawing Figures

GEAR REDUCTION STARTER DRIVE

This invention relates to starting apparatus for cranking an internal combustion engine and more particularly to starting apparatus that utilizes an in-line single shaft gear reduction apparatus for driving a pinion that meshes with the ring gear of the engine to be cranked.

Starter drives that utilize a gear reduction set to drive a pinion from the armature of a cranking motor are known in the prior art, examples being the drives disclosed in the U.S. patents to Rodriguez U.S. Pat. No. 3,209,603 and to Colvin et al. U.S. Pat. No. 4,412,457.

The Rodriguez patent utilizes an in-line gear reduction drive but requires two separate aligned shafts. Thus, in this patent the armature shaft and the shaft that supports the pinion are two separate and distinct shafts.

In the Colvin et al. patent an in-line gear reduction starter drive is disclosed wherein a single central shaft extends from one end of the starter to the other end. The pinion is supported by one portion of the shaft and a hollow armature shaft is provided which drives the sun gear of a planetary gear set. The hollow armature shaft is supported for rotation on the central shaft.

The present invention differs from the Rodriguez patent in that it utilizes a single central shaft that is connected to the armature of the motor and which also supports the pinion. Moreover, the starter drive of this invention does not require a hollow armature shaft of the type disclosed in the above-referenced Colvin et al. patent.

It accordingly is one of the objects of this invention to provide an improved in-line gear reduction starter pinion drive wherein a single central shaft supports the pinion and is directly connected to the core of the armature. In carrying this object forward, the armature shaft is provided with an integral sun gear which meshes with a plurality of planet gears that in turn drive a tubular member that is rotatably supported by a portion of the central shaft. The tubular member drives and supports a part of a starter drive that in turn drives the pinion through an overrunning clutch.

It will be apparent that the starter drive that has just been described, as compared to the Rodriguez patent, does not have the assembly difficulties of numerous parts and bearings registering with one another. The single shaft design should also be shorter in length, weigh less and be of low cost.

As compared to the Colvin et al. patent, a starter drive made in accordance with this invention does not require a hollow armature shaft which must be rotatably supported by bearings carried by the single central shaft and accordingly a reduction of parts and ease of assembly is achieved when utilizing this invention.

Another object of this invention is to provide an in-line gear reduction starter pinion drive which does not require a fixed ring gear that is supported by the frame of the cranking motor. In carrying this object forward, a planetary gear drive is formed from the use of dual gears which cooperate to provide a planetary gear set. The gears may be formed from pressed powdered metal. In this embodiment of the invention the apparatus still utilizes the single in-line shaft design and this shaft has an integral sun gear which drive planet gears.

IN THE DRAWINGS

Figure 1:
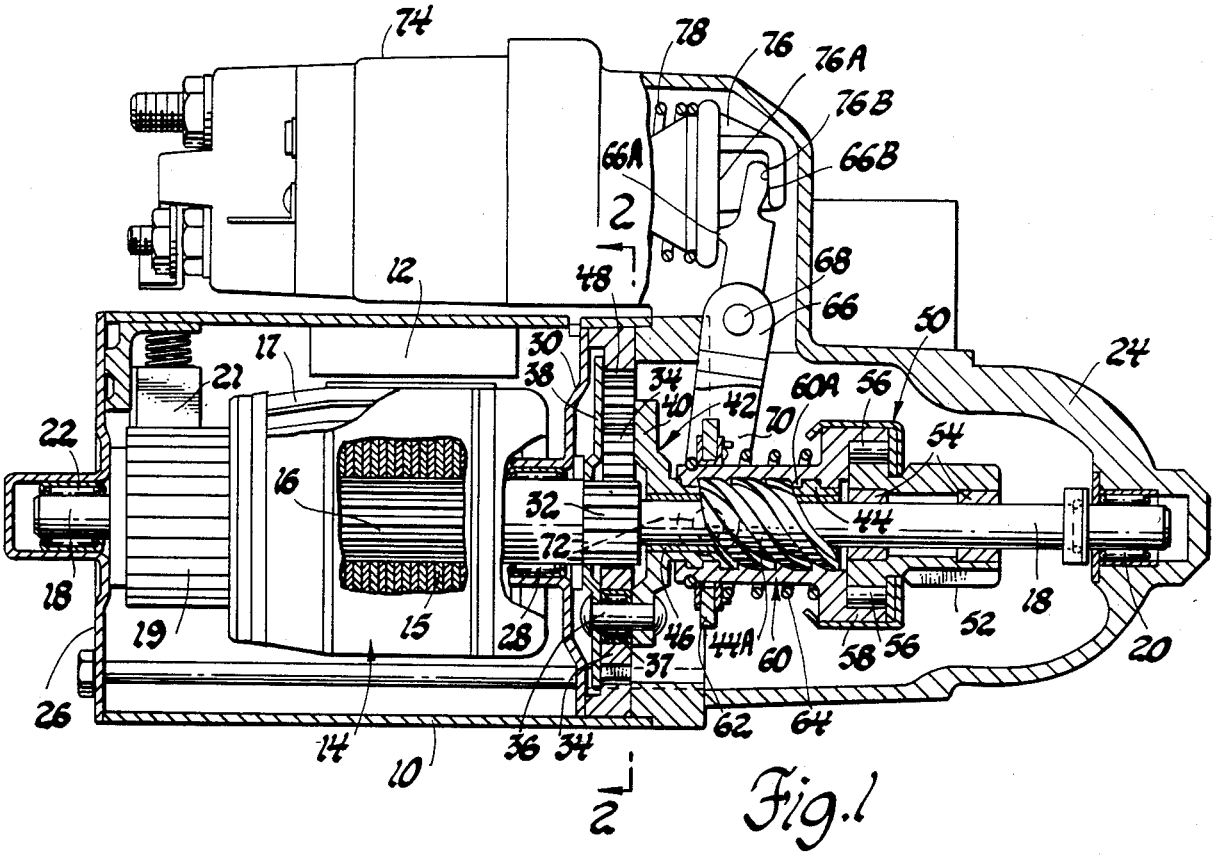
FIG. 1 is a view with parts broken away and partly in section of a starter drive made in accordance with this invention.

Referring now to the drawings and more particularly to FIG. 1, the reference numeral 10 designates the frame of an electric cranking motor. The frame 10 supports a plurality of circumferentially spaced field flux generating devices, one of which is illustrated and designated by reference numeral 12. The flux generating devices 12 may be conventional field coils or permanent magnets. The electric cranking motor has an armature designated by reference numeral 14 which has a usual laminated core 15 formed of magnetic material which is connected to a splined section 16 of a shaft 18. The steel laminations that form the armature core 15 have slots that receive armature conductors 17. The conductors 17 are connected to the bars of a commutator 19 which is engaged by brushes, one of which is illustrated and designated by reference numeral 21.

The shaft 18 is a one-piece steel shaft and extends the entire length of the starter, that is it extends between bearings 20 and 22. The bearing 20 is supported in a nose housing 24 while the bearing 22 is supported by the end frame 26. The shaft 18 is also rotatably supported by a center roller bearing 28 that is in turn supported by motor frame part 30.

The mid portion of the shaft 18 has an integral gear 32 which, as will be more fully described hereinafter, forms a sun gear for a planetary gear set. The gear 32 may be formed by a cold forming operation performed on shaft 18.

The gear 32 drives three planet gears, each designated by reference numeral 34. The planet gears 34 are respectively journaled for rotation on pins 36 by roller bearings 37. The pins 36 are fixed re-spectively to a rotatable plate 38 and to an annular portion 40 of a driven member generally designated by reference numeral 42. The driven member 42 has a tubular portion 44 that can rotate on the shaft 18. A bronze bushing 46 is carried by the tubular portion 44 of driven part 42 so as to form a bearing between part 42 and the shaft 18.

The planet gears 34 mesh with the teeth of a ring gear 48 which is fixed to the frame of the cranking motor. It will be appreciated that the sun gear 32, the planet gears 34 and the ring gear 48 provide a gear reduction planetary gear set which drives the driven part 42 at a reduced speed compared to the speed of rotation of the armature 14.

The part 42 drives a conventional starter drive generally designated by reference numeral 50. This starter drive includes a pinion gear 52 which at times is meshed with the ring gear of an engine to be cranked. In this regard, the housing 24 has an opening (not illustrated) to accommodate meshing of the pinion 52 with the ring gear of the engine. The pinion 52 has bushings 54 for slidably and rotatably supporting the pinion 52 on the shaft 18.

The pinion 52 is driven by part 42 through an overrunning clutch that comprises a plurality of spring biased rollers 56. This clutch further includes an outer clutch shell 58 connected to a tubular part 60. The inner surface of the outer shell 58 cooperates with the rollers in a manner well known to those skilled in the art and the clutch may be of the type disclosed in the U.S. patent to House et al. U.S. Pat. No. 2,902,125.

The tubular part 60 has internal helical splines 60A which cooperate with external helical splines 44A formed on the outer periphery of tubular portion 44 of the part 42 which may be of the general type disclosed in the above-referenced House et al. patent. The purpose of the helical spline connection is to cause the starter drive to rotate slightly whenever the part 60 is shifted axially relative to the shaft 18 to cause the pinion 52 to mesh with the ring gear of the engine.

The mechanism for shifting the starter drive 50 comprises a disk or collar 62 which is slidably supported on tubular part 60. A jump spring 64 is interposed between the disk 62 and the outer shell 58 of the starter drive. The disk 62 is shifted axially relative to the shaft 18 by a shift lever 66 which is pivoted on a pin 68. The shift lever has a forked portion 70, the lower ends of which have openings to receive pins 72 carried by the disk 62.

The shift lever 66 is shifted by a starter solenoid which is generally designated by reference numeral 74. The starter solenoid includes the usual hold-in and pull-in coils and has a plunger (not illustrated) which is pulled in when the solenoid coils are energized. The plunger of the solenoid is connected to a part 76 which has opposed walls 76A and 76B which respectively engage surfaces 66A and 66B of the shift lever 60. When the solenoid coils are energized the part 76 is moved to the left, in FIG. 1, causing the shift lever 66 to pivot counter-clockwise, in FIG. 1, and causing the starter drive 50 to shift to the right, in FIG. 1, toward a meshing condition with the ring gear of the engine. When the solenoid coils are deenergized a spring 78 pivots the shift lever 66 clockwise, in FIG. 1, to cause the pinion 52 to be pulled out of mesh with the ring gear of the engine.

When the cranking motor is energized it will be appreciated that the part 42 is driven at a reduced speed as compared to the speed of rotation of shaft 18 due to the action of the planetary gear set comprised of sun gear 32, planet gears 34 and ring gear 48. When the tubular part 44 drives the tubular part 60 through the helical spline connection between these parts the clutch shell 58 is accordingly driven to drive the pinion 52 through the rollers of the overrunning clutch.

Figure 2:
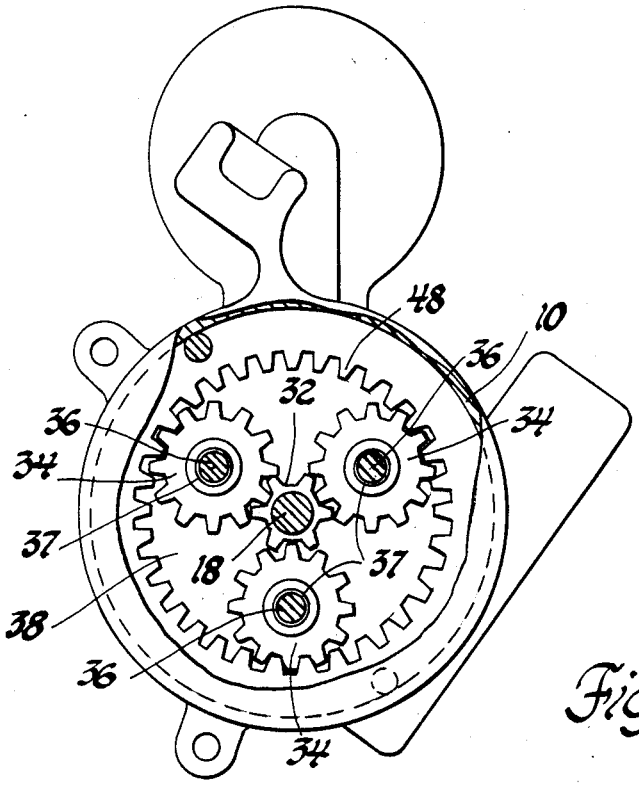
FIG. 2 is a view with parts broken away taken along line 2—2 of FIG. 1 illustrating the planetary gear apparatus of the starter drive of this invention.
Figure 3:
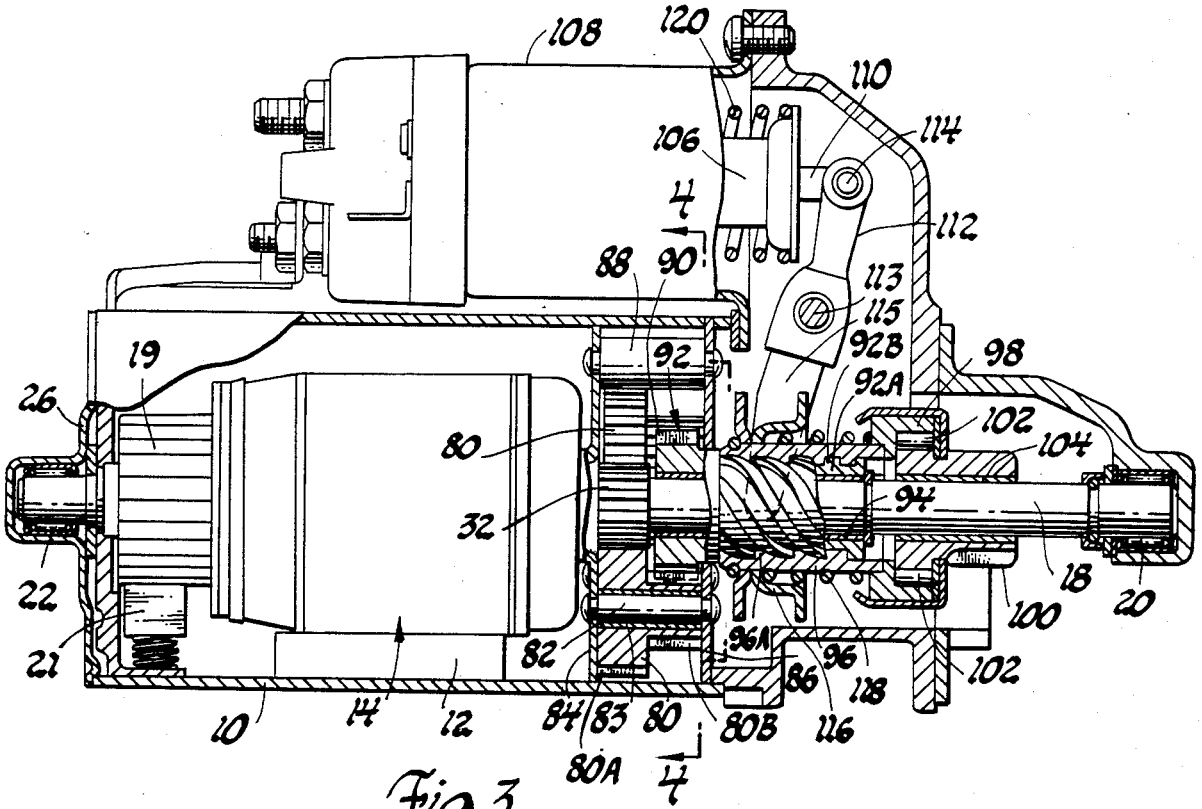
FIG. 3 is a view similar to FIG. 1 which illustrates a modified planetary gear drive for driving the pinion of a st apparatus.
Figure 4:
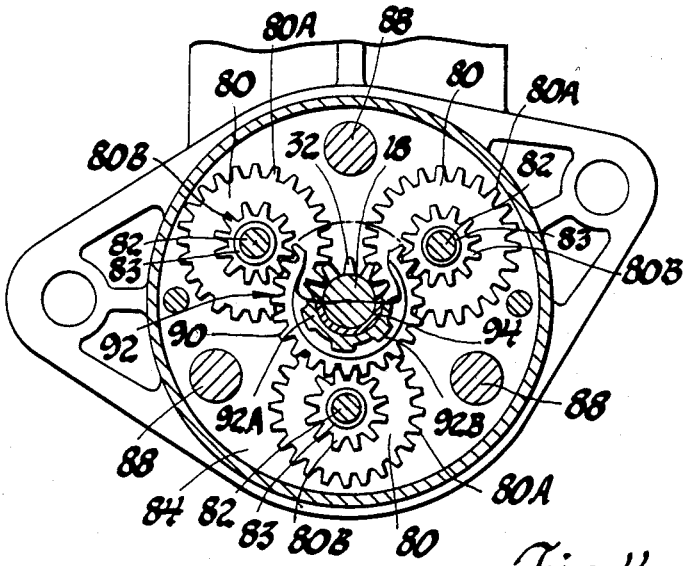
FIG. 4 is a view taken along lines 4—4 of FIG. 3 and illustrating the relationship of the gears of a planetary gear set utilized in this starter drive.

Referring now to FIGS. 3 and 4, a modified planetary gear set starter drive is illustrated which does not utilize a ring gear fixed to the frame of the cranking motor but rather utilizes dual or stepped gears that define a planetary gear set. In FIGS. 3 and 4 the same reference numerals have been utilized as were used in FIGS. 1 and 2 in order to identify corresponding parts.

In FIGS. 3 and 4, the sun gear 32 drives three planet gears 80. Each planet gear 80 is journaled for rotation on a pin 82 by a sleeve bearing 83. The pins 82 are connected between fixed plates 84 and 86 that are fixed to the frame of the cranking motor. The plates are also fixed, with respect to each other, by parts 88 so that the planetary gear set can be assembled as a unit to the frame of the cranking motor. Each planet gear 80 has a larger diameter gear portion 80A and an integral axially extending smaller diameter gear portion 80B. These planet gears are preferably formed as pressed powdered metal parts.

The larger diameter gear portions 80A of gears 80 mesh with the sun gear 32 while the smaller diameter gear portions 80B of the gears 80 mesh with gear teeth 90 formed on a driven part generally designated by reference numeral 92. The driven part 92 is rotatably supported on the shaft 18 by a bronze bushing 94 which forms a bearing and which is carried by part 92.

The tubular portion 92A of part 92 has external helical splines 92B which cooperate with internal helical splines 96A formed on tubular part 96. The part 96 is connected with a clutch shell 98 which forms a part of an overrunning clutch for driving the pinion 100. This clutch includes spring biased rollers 102 and can be of the same type as that illustrated in FIG. 1. The pinion 100 has a bearing bushing 104 engaging the shaft 18.

The mechanism for shifting pinion 100 into and out of mesh with the ring gear of the engine comprises a solenoid plunger 106 of starter solenoid 108. The plunger 106 is connected with a part 110 which in turn is pivotally connected to a shift lever 112 by a pin 114. The shift lever 112 is pivoted to pin 113 and has the usual forked portion 115 which cooperates with a collar 116. A jump spring 118 is interposed between the shift coller 116 and the clutch shell 98 of the overrunning clutch.

When the coils of the starter solenoid 108 are energized the shift lever 112 is pivoted counterclockwise, in FIG. 3, causing the collar 116 to be shifted to the right, in FIG. 3, and further causing the pinion 100 to be moved to the right, in FIG. 3.

When the solenoid 108 is deenergized the spring 120 returns the shift lever 112 and the pinion 100 to the position illustrated in FIG. 3.

When the cranking motor is energized the armature 14 directly drives the sun gear 32 at the speed of rotation of the armature and the sun gear drives the planet gears 80. The planet gears 80 in turn drive the gear 90 of part 92 which rotates on the shaft 18 at a reduced speed as compared to the speed of rotation of the armature 14. Rotary movement of the part 92 is imparted to the pinion 100 via the helical spline connection between parts 92 and 96 and the overrunning clutch.

The embodiments of the invention for which an exclusive property or privilege is claimed are defined as follows:

1. An electric cranking motor drive comprising, an electric cranking motor having housing means, an armature and a shaft fixed to the armature, said shaft rotatably supported by said housing means and having a first portion extending in one direction from said armature and a second portion extending in an opposite direction from said armature, said first and second portions rigidly connected to each other and to said armature, a driven member having a tubular portion disposed about and rotatably supported by said second portion of said shaft, said second portion of said shaft extending entirely through said driven member, reduction gearing connecting said shaft and said driven member comprising a gear connected to said second portion of said shaft for driving said driven member from said second portion of said shaft through said gearing, a pinion slidably and rotatably supported by said second portion of said shaft, a sleeve connected to said pinion disposed about at least a portion of said driven member, said sleeve being slidable axially relative to said driven member and being rotatably driven thereby, whereby said pinion can be shifted axially relative to said shaft and can be rotatably driven by said sleeve and driven member, and means coupled to said sleeve for shifting said sleeve axially relative to said driven member and shaft.

2. An electric cranking motor drive comprising, an electric cranking motor having housing means, an armature having an armature core carrying armature conductors and a one-piece shaft having a portion thereof directly connected to the armature core, said shaft rotatably supported by said housing means and having a first portion extending in one direction from said armature core and a second portion extending in an opposite direction from said armature core, a driven member having a tubular portion disposed about and rotatably supported by said second portion of said shaft, said second portion of said shaft extending entirely through said driven member, reduction gearing connecting said shaft and said driven member comprising a gear that is integral with said second portion of said shaft for driving said driven member from said second portion of said shaft through said gearing, a pinion slidably and rotatably supported by said second portion of said shaft, a sleeve connected to said pinion disposed about at least a portion of said driven member, said sleeve being slidable axially relative to said driven member and being rotatably driven thereby, whereby said pinion can be shifted axially relative to said shaft and can be rotatably driven by said sleeve and driven member, and means coupled to said sleeve for shifting said sleeve axially relative to said driven member and shaft.

3. An electric cranking motor drive comprising, an electric cranking motor having housing means, an armature having an armature core carrying armature conductors and a one-piece shaft having a portion thereof directly connected to the armature core, said shaft rotatably supported by said housing means and having a first portion extending in one direction from said armature core and a second portion extending in an opposite direction from said armature core, a driven member having a tubular portion disposed about and rotatably supported by said second portion of said shaft, said second portion of said shaft extending entirely through said driven member, planetary reduction gearing connecting said shaft and said driven member for driving said driven member from said shaft through said gearing, said reduction gearing comprising a sun gear which is integral with said shaft, a ring gear fixed to said housing means, and a plurality of planet gears meshed with said sun gear and ring gear and coupled to said driven member to rotatably drive the driven member, a pinion slidably and rotatably supported by said second portion of said shaft, a sleeve connected to said pinion disposed about at least a portion of said driven member, said sleeve being slidable axially relative to said driven member and being rotatably driven thereby, whereby said pinion can be shifted axially relative to said shaft and can be rotatably driven by said sleeve and driven member, and means coupled to said sleeve for shifting said sleeve axially relative to said driven member and shaft.

4. An electric cranking motor drive comprising, an electric cranking motor having housing means, an armature and a shaft fixed to the armature, said shaft rotatably supported by said housing means and having a first portion extending in one direction from said armature and a second portion extending in an opposite direction from said armature, said first and second portions rigidly connected to each other and to said armature, a driven member having a tubular portion disposed about and rotatably supported by said second portion of said shaft, said second portion of said shaft extending entirely through said driven member, reduction gearing connecting said shaft and said driven member for driving said driven member from said shaft through said gearing, said reduction gearing comprising a sun gear connected to said second portion of said shaft, a plurality of planet gears each rotatably supported by a pin that is fixed with respect to said housing means, each planet gear having a first gear portion that is meshed with said sun gear and an integral axially spaced second gear portion that is meshed with a gear that is connected to said driven member, a pinion slidably and rotatably supported by said second portion of said shaft, a sleeve connected to said pinion disposed about at least a portion of said driven member, said sleeve being slidable axially relative to said driven member and being rotatably driven thereby, whereby said pinion can be shifted axially relative to said shaft and can be rotatably driven by said sleeve and driven member, and means coupled to said sleeve shifting said sleeve axially relative to said driven member and shaft.

5. An electric cranking motor drive comprising, an electric cranking motor having housing means, an armature having an armature core carrying armature conductors and a one-piece shaft having a portion thereof directly connected to the armature core, said shaft rotatably supported by said housing means and having a first portion extending in one direction from said armature core and a second portion extending in an opposite direction from said armature core, a driven member having a tubular portion disposed about and rotatably supported by said second portion of said shaft, said second portion of said shaft extending entirely through said driven member, reduction gearing connecting said shaft and said driven member for driving said driven member from said second portion of said shaft through said gearing, said reduction gearing comprising a sun gear which is integral with said second portion of said shaft, a plurality of planet gears each rotatably supported by a pin that is fixed with respect to said housing means, each planet gear having a first gear portion that is meshed with said sun gear and an integral axially spaced second gear portion that is meshed with a gear that is connected to said driven member, the diameter of said first gear portions being greater than the diameter of said second gear portions, a pinion slidably and rotatably supported by said second portion of said shaft, a sleeve connected to said pinion disposed about at least a portion of said driven member, said sleeve being slidable axially relative to said driven member and being rotatably driven thereby, whereby said pinion can be shifted axially relative to said shaft and can be rotatably driven by said sleeve and driven member, and means coupled to said sleeve for shifting said sleeve axially relative to said driven member and shaft.

* * * * *